US005718023A

United States Patent [19]

Billish

[11] Patent Number: 5,718,023

[45] Date of Patent: Feb. 17, 1998

[54] PEN HOLDER WITH CLIP

[76] Inventor: Thomas P. Billish, 10436 S. Campbell, Chicago, Ill. 60655

[21] Appl. No.: 674,430

[22] Filed: Jul. 2, 1996

Related U.S. Application Data

[63] Continuation-in-part of Ser. No. 540,704, Oct. 11, 1995.

[51] Int. Cl.[6] ..... B43K 25/00

[52] U.S. Cl. ..... 24/11 HC; 24/3.9; 24/336; 224/219; 224/674; 224/251

[58] Field of Search ..... 24/11 R, 11 HC, 24/11 CC, 3.9, 3.7, 336, 339, 482; 224/218, 219, 242, 247, 250, 251, 269, 277, 666, 671, 672, 674, 678, 680, 904

[56] References Cited

U.S. PATENT DOCUMENTS

| | | | |
|---|---|---|---|
| 194,306 | 8/1877 | Marshall et al. | 24/11 CC X |
| D. 203,101 | 12/1965 | Holder . | |
| 313,762 | 3/1885 | Pattee | 24/336 X |
| 428,239 | 5/1890 | Way . | |
| 743,399 | 11/1903 | Seebold . | |
| 1,100,583 | 6/1914 | Legan . | |
| 1,485,647 | 2/1924 | Gise | 224/219 X |
| 2,007,696 | 7/1935 | Siebert | 224/674 X |
| 2,270,702 | 1/1942 | Getmansky . | |
| 2,292,029 | 8/1942 | Gold . | |
| 2,850,152 | 9/1958 | Marrufo | 224/674 X |
| 2,876,513 | 11/1959 | McIntosh . | |
| 3,627,182 | 12/1971 | Calkins | 224/219 X |
| 3,682,981 | 8/1972 | Previdi | 224/674 X |
| 4,155,183 | 5/1979 | Abrahams . | |
| 4,433,803 | 2/1984 | Liberboim | 224/251 |
| 4,613,068 | 9/1986 | Bianchi . | |
| 4,779,777 | 10/1988 | Johnson . | |
| 4,852,221 | 8/1989 | Antonnucci . | |
| 4,955,518 | 9/1990 | Parsons et al. | 224/247 |
| 5,077,869 | 1/1992 | Haase . | |
| 5,330,085 | 7/1994 | Horensky . | |
| 5,408,728 | 4/1995 | Wisniewski . | |
| 5,446,953 | 9/1995 | Lefeber . | |
| 5,460,346 | 10/1995 | Hirsch . | |
| 5,491,878 | 2/1996 | Janouschek . | |
| 5,573,167 | 11/1996 | Bebb et al. | 224/666 |

*Primary Examiner*—Peter M. Cuomo
*Assistant Examiner*—Hanh V. Tran
*Attorney, Agent, or Firm*—Don Moyer

[57] ABSTRACT

A holder for securely holding pens and pencils, and the like, has a body with an elastic sheath attached so that pens and pencils, and the like, can be inserted easily into the sheath through mouths at either end of the sheath, be secured reliably in the sheath, and be removed easily from the sheath through either mouth. The holder also has a clip attached to the holder body so that the holder can be clasped over the edge of a belt or waist band or similar surfaces.

4 Claims, 1 Drawing Sheet

PEN HOLDER WITH CLIP

This application is continuation-in-part of copending U.S. application Ser. No. 08/540,704 for "Pencil and Pen Holder With Clasp" filed Oct. 11, 1995.

BACKGROUND, OBJECTS, AND SUMMARY OF THE INVENTION

This invention relates to a holder which can securely and removably hold pens, pencils, other writing instruments, and similarly shaped objects, all referred to here generically as pens, and which has a clip so that the holder can be securely and removably clasped to an article of clothing and alternatively can be clasped to other surfaces.

Pens are normally carried in shirt pockets, often in the familiar pocket protector. Pencil boxes and cases for carrying pens are also familiar. As well it is common to see devices for holding a pen at a place of use, such as a gripper attached to a telephone or a sleeve attached to a notebook.

However, problems can arise when people wear clothes which do not have pockets which can easily carry pens and they do not wish to hand carry a separate case for pens. To address this Seebold's U.S. Pat. No. 743,399 proposes a device to help people carry one pen behind an ear, and Antonucci's U.S. Pat. No. 4,852,221 proposes a device for attaching one pen to the ear piece of a pair of eyeglasses. The first device may not be secure nor comfortable enough for many, and the second device requires that the user wear glasses to which the device can be attached. There is need for a more secure, more comfortable, and more generally usable device.

In U.S. Pat. No. 1,100,583 Legan shows a holder with an elastic member which can contain several pens and with attaching members which could attach the holder to an article of clothing. Because of the location and orientation of the attaching member, this holder could not be clasped over the edge of a belt with the long dimension of the holder parallel to the long dimension of the belt. There is need for a device which can be worn less conspicuously, by clasping to a belt or waist band for example.

It is common practice to attach items to a belt, in the cartridge belt shown by Bianchi in U.S. Pat. No. 4,613,068 for example. Bianchi's object is to attach the greatest possible number of items and thus the items are oriented vertically in short sheaths, with the long dimension of the attached items oriented perpendicular to the long dimension of the belt.

In order to best attach an item, such as a pen, which is much longer than its diameter, into an elastic sheath, which is attached to a surface such as Legan's holder or Bianchi's belt, there is need for art not taught by Bianchi, or Legan, or others. It is not sufficient, for example, to attach a Bianchi sheath to a Legan holder because it is also necessary to devise a configuration for the sheath to solve a problem which arises when a pen is inserted into a sheath. When a pen is being inserted into a sheath, the material of the sheath, which must be tight enough and long enough to securely hold the pen, bunches up ahead of the pen and elastically opposes motion of the pen into the sheath.

Thus, there remains an opportunity to devise a pen holder which can removably secure at least one pen, which can removably secure pens in any orientation of the holder, which allows easy insertion of pens into the holder, and which can be removably clasped to surfaces, such as a belt and waist band, and to other surfaces.

Objects of this invention include the following. Make a holder which can removably secure at least one pen. Make a holder so that the pen can be inserted easily therein and can be removed easily therefrom. Make a holder which is open at two ends so that a pen can be inserted and removed through either end. Make a holder which can be removably clasped to a surface, such as a belt and a waist band, and alternatively can be removably clasped to other external surfaces. Make a holder which can be clasped over the edge of a belt so that the long dimension of a pen is parallel to the long dimension of the belt.

In Summary, one embodiment of this invention is a holder which has a body which has a front surface and a back surface, the holder having at least one elastic sheath attached to the body and located at the front surface, the elastic sheath having a first mouth, having a second mouth, and having elastic properties so that a pen can be removably secured in the sheath and so that forces opposing motion of the pen into the sheath are minimized, and the holder having a clip attached to the body and located at the back surface so that the holder can be removably clasped to a surface, such as a belt, a waist band, and other similar surfaces.

Other equivalent embodiments will be comprehended in the detailed description of the drawings, which will make additional equivalent embodiments hereafter obvious to people skilled in the art.

DETAILED DESCRIPTION OF THE DRAWINGS

Figure 1:
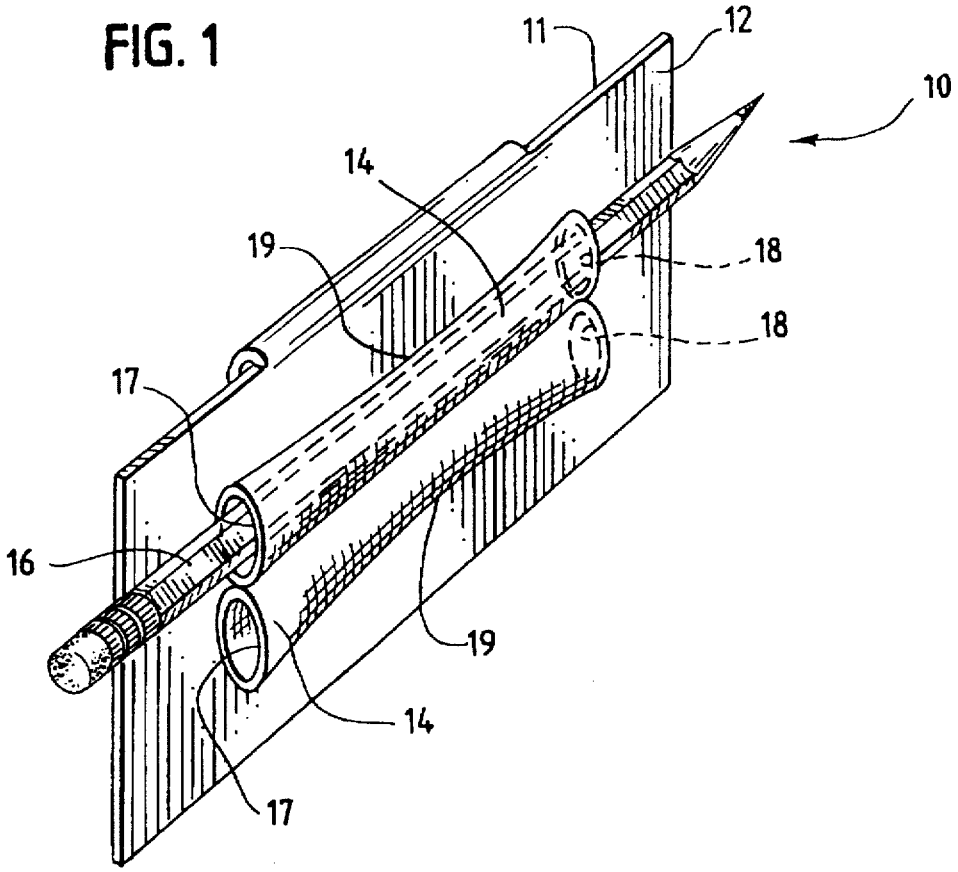
FIG. 1 shows the front of the new holder.

The hew holder 10 for holding pens, pencils, other writing instruments, and similarly shaped objects, all referred to here generically as pens, is shown in FIG. 1. The holder has a body 11 which has a front surface 12 and has generally identical elastic sheaths 14 attached to the body and located at the front surface. Each sheath 14 has an inside periphery which can be seen at a first mouth 17. A pen 16 can be inserted into, and removed from, the sheath through the first mouth 17 in the sheath and alternatively can be inserted into, and removed from the sheath through a second mouth 18 in the sheath. The elasticity of the sheath securely holds pens and pencils in the holder. The length of the sheath is less than the length of a typical pen so that a typical pen can be held in the sheath with the ends the pen protruding out of each of the sheath mouths, 17 and 18, which allows easy removal of a pen from the sheath through either of the mouths.

Two sheaths 14 are shown because this has been found to be optimal for a holder which will be preferentially clasped over the edge of a typical belt with the long dimension of the holder parallel to the long dimension of the belt. Holders with one sheath and with more than two sheaths can also be made according to the principals shown here. The elastic sheath 14 could also be open along its long dimension, so that a pen can also be inserted through this long opening, if the sheath is made of appropriate material. The sheath inside periphery in this case would be the periphery of a pen inserted into the sheath. The sheath could also be integral to the body 11.

A typical pen can be twenty times longer than the pen diameter and this presents a problem. The sheath 14 must be long enough to hold the pen securely. Otherwise the elasticity of the sheath would allow the pen to rotate on an axis perpendicular to the long dimension of the pen. The sheath must also be tight enough to hold the pen securely. Otherwise the pen could fall out of a mouth 17 and 18 of the holder by the action of gravity or impulse forces which could be encountered in normal use. Unfortunately a sheath long enough and elastic enough to meet these conditions will bunch up ahead of a pen being inserted into the sheath and the bunched sheath material will elastically oppose motion of the pen into the sheath.

To solve this problem it is necessary to devise elastic properties for the sheath so that forces opposing insertion of a pen are minimized and so that a pen can be removably secured in the sheath. One way to do this is to devise a sheath which has elasticity which is least at the first mouth 17 and at the second mouth 18 and which increases from each mouth toward the mid-point 19 of the sheath. This can be achieved as shown in FIG. 1 by making the sheath out of material which elastically opposes increase of the inside periphery of the sheath and by making the inside periphery of the sheath greatest at the first mouth 17 and at the second mouth 18 and making the inside periphery of the sheath decrease from each mouth toward the mid-point 19. Thus, when a pen is inserted into the first mouth 17, and alternatively inserted into the second mouth 18, there will be little elastic opposition to motion into the sheath, and when the pen is fully inserted into the sheath the pen will be securely held.

Figure 2:
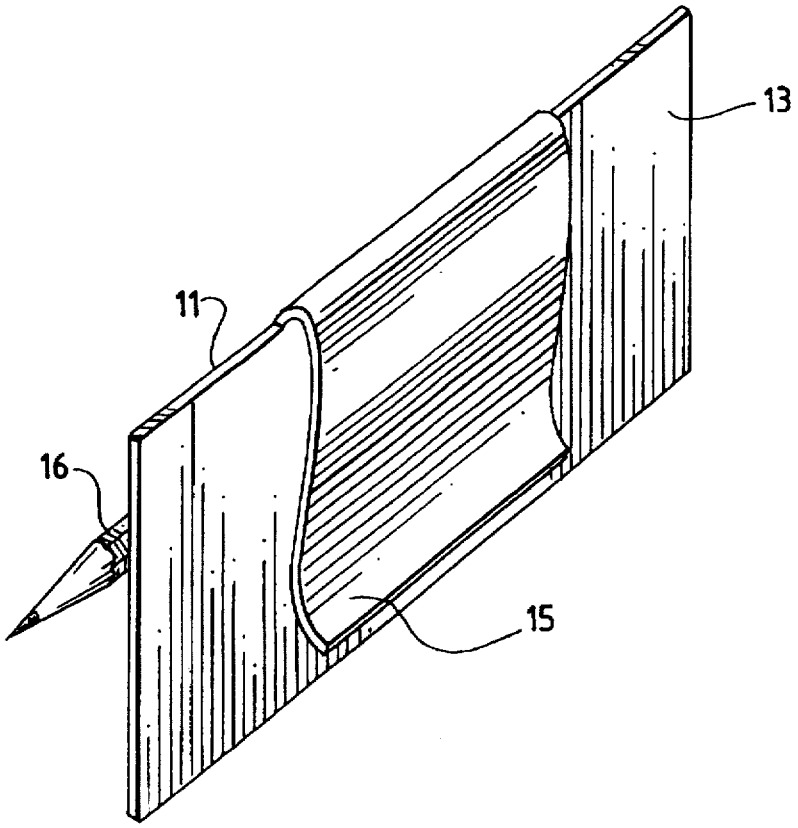
FIG. 2 shows the back of the holder.

The body 11 of the holder has a back surface 13 seen in FIG. 2 and has a clip 15 attached to the body and located at the back surface. Here the clip is shown to be an integral part of the body 11. There are many other ways the clip could be attached to the body, and many other clasping devices can be used in place of the clip. The clip 15 shown in FIG. 2 is especially useful for securely and removably clasping the holder over the edge of a belt, a waist band, and any similar external surfaces such as the cover of a book. With the orientation of the clip on the holder body shown in FIG. 2 the holder can be attached over the edge of a belt with the sheath, and thus the held pen, parallel to the edge of the belt so that the device will not impede bending and other movements by the user.

Other equivalent forms for the body, other means equivalent to the sheath for holding a pen, other equivalent clasping means, other equivalent orientations of the clip relative to the sheath, and other equivalent means for attaching these elements together will be hereafter obvious to people skilled in the art. It is understood therefore that this invention is not limited to the particular examples illustrated here.

I claim:

1. A pen holder comprising:

a body, the body having a front surface and a back surface;

at least one sheath, the sheath being attached to the body and located at the body front surface, the sheath having an inside periphery, a first mouth, a second mouth, and a mid-point so that a pen can be inserted into the sheath and removed from the sheath through the first mouth and so that alternatively the pen can be inserted into the sheath and removed from the sheath through the second mouth, the sheath being elastic, the sheath elasticity being least at the sheath first mouth and at the sheath second mouth and the sheath elasticity increasing from the sheath first mouth and from the sheath second mouth toward the sheath mid-point so that the pen can be removably secured in the sheath and so that forces opposing motion of the pen into the sheath are minimized; and a clip, the clip being attached to the body and located at the body back surface, the clip for securely and removably clasping the body to an external surface.

2. The pen holder of claim 1 wherein the clip is oriented so that when the body is clasped over an edge of the external surface the sheath is parallel to the edge.

3. A pen holder comprising:

a body, the body having a front surface and a back surface;

at least one sheath, the sheath being attached to the body and located at the body front surface, the sheath having an inside periphery, a first mouth, a second mouth, and a mid-point so that a pen can be inserted into the sheath and removed from the sheath through the first mouth and so that alternatively the pen can be inserted into the sheath and removed from the sheath through the second mouth, the sheath being elastic, the sheath elasticity opposing increase of the sheath inside periphery, the sheath inside periphery being greatest at the first mouth and at the second mouth, and the sheath inside periphery decreasing from the sheath first mouth and from the sheath second mouth toward the sheath mid-point so that the pen can be removably secured in the sheath and so that forces opposing motion of the pen into the sheath are minimized; and a clip, the clip being attached to the body and located at the body back surface, the clip for securely and removably clasping the body to an external surface.

4. The pen holder of claim 3 wherein the clip is oriented so that when the body is clasped over an edge of the external surface the sheath is parallel to the edge.

* * * * *